US006102218A

United States Patent [19]

Alfonso et al.

[11] Patent Number: 6,102,218

[45] **Date of Patent: *Aug. 15, 2000**

[54] COMPUTER SYSTEM INCLUDING A HANGING SUPPORT BRACKET

[75] Inventors: Pedro Alfonso, Austin, Tex.; Benjamin Trapp, Fairfax, Va.

[73] Assignee: Dell USA, L.P., Round Rock, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/193,696

[22] Filed: Nov. 17, 1998

[51] Int. Cl.[7] ..... A47G 29/087

[52] U.S. Cl. ..... 211/119; 248/303

[58] Field of Search ..... 211/119, 181.1, 211/50, 26; 248/302, 303

[56] References Cited

U.S. PATENT DOCUMENTS

| | | | |
|---|---|---|---|
| D. 264,761 | 6/1982 | Dekarski . | |
| 904,080 | 11/1908 | Orin | 211/181.1 |
| 917,170 | 4/1909 | Short | 211/119 |
| 1,235,225 | 7/1917 | Miller | 211/119 |
| 2,221,659 | 11/1940 | Wilkie | 211/119 |
| 3,789,996 | 2/1974 | Stroh | 211/119 |
| 4,356,651 | 11/1982 | Barlow . | |
| 4,672,703 | 6/1987 | Frazier | 211/119 |
| 4,895,334 | 1/1990 | Bajek et al. . | |
| 4,943,029 | 7/1990 | Szunster . | |
| 5,542,314 | 8/1996 | Sullivan et al. | 211/119 |

FOREIGN PATENT DOCUMENTS

| | | | |
|---|---|---|---|
| 2454316 | 5/1976 | Germany | 211/119 |

*Primary Examiner*—Peter M. Cuomo
*Assistant Examiner*—Jerry A. Anderson
*Attorney, Agent, or Firm*—Haynes and Boone, LLP

[57] ABSTRACT

A computer system according to which a bracket supports a computer chassis on a structure having an accessible upper edge. The bracket is formed by a plurality of support members for receiving the chassis and for engaging the chassis in a manner to prevent movement of the chassis relative to the bracket. At least one hook is connected to the support member for extending over the edge to support the support member, and therefore the chassis, relative to the structure.

22 Claims, 2 Drawing Sheets

COMPUTER SYSTEM INCLUDING A HANGING SUPPORT BRACKET

TECHNICAL FIELD

This disclosure relates in general to computer systems and more particularly to a computer system including a chassis, or central processing unit (CPU) that is mounted to a wall by a bracket.

BACKGROUND

A desktop computer system consists of a monitor, a keyboard, and a computer chassis, or CPU. Typically, the computer chassis resides on the desktop either in a horizonal orientation underneath the monitor, or in a vertical orientation to the side of the monitor. However, in environments where user space is limited, such as relatively small cubicles, and the like, the computer chassis takes up a significant amount of space.

In order to reduce the amount of desktop space required by the footprint of the computer chassis, the chassis has been mounted in an upright position on the floor adjacent the desk. However, in this position, the chassis is susceptible to picking up unwanted dirt and debris. Also, the chassis is often bumped or jarred by being accidentally kicked or hit by cleaning equipment and the like.

Computer stands have been developed for supporting a computer chassis and/or monitor on the desktop and for supporting the computer chassis on the floor. These stands, however, do not solve the desktop space problem and do not eliminate the problems associated with floor mounted chassis.

Therefore, what is needed is a bracket that mounts a computer chassis to a wall and thus eliminates the problems associated with supporting the chassis on the desktop or the floor.

SUMMARY

To this end a computer system is provided according to which a bracket supports a computer chassis on a structure having an accessible upper edge. The bracket is formed by a plurality of support members for receiving the chassis and for engaging the chassis in a manner to prevent movement of the chassis relative to the bracket. At least one hook is connected to the support member for extending over the edge to support the support member, and therefore the chassis, relative to the structure.

A principal advantage of this embodiment is that the computer chassis is removed from the desktop and floor environments but is supported at the work station near the monitor and keyboard. Also, the dimensions of the bracket can be selected so that it chassis fits in it in a relatively tight fit to prevent the chassis from rocking back and forth in any direction. Moreover, the bracket can be quickly removed and installed in a different location by one person. Further, the hook will fit over any conventional modular wall having an exposed upper edge portion, even those with varying thicknesses, since the top of the wall will naturally find the balanced center within the hook and properly seat the bracket.

Also, even though the chassis is well supported, a relatively large portion of the outer surface of the chassis is directly exposed to air so that its thermal integrity will not be affected. Further, the bracket does not restrict the access to any plugs, cables, switches, buttons, indicators, ports, drive openings, etc. on the front and the rear of the chassis.

Moreover, the bracket is very versatile in the sense that it can be installed on either side of a cubicle wall and computer orientation with the bracket becomes intuitively obvious to the installer/user. Still further, the hook will not permanently deform or mark the cubicle wall surfaces.

DETAILED DESCRIPTION OF THE PREFERRED EMBODIMENT

Figure 1:
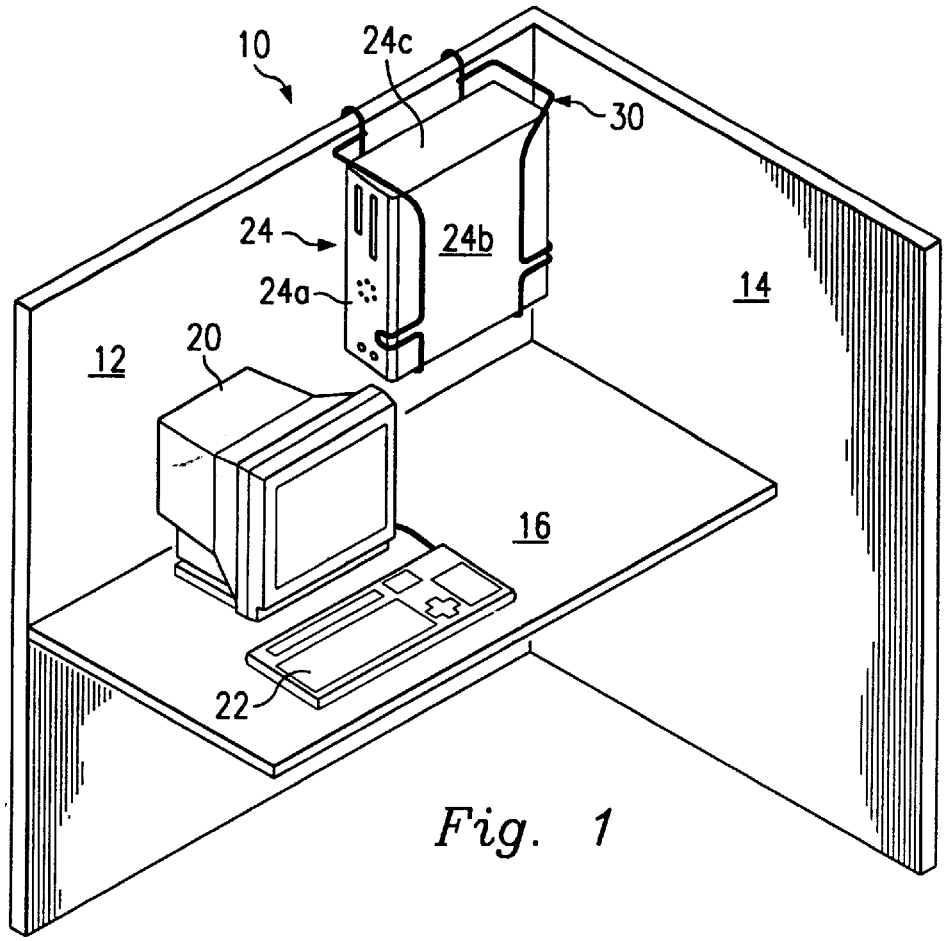
FIG. 1 is an isometric view illustrating an embodiment of a computer system located in a cubicle and including a bracket supporting a computer chassis.

In accordance with the embodiment of the present invention shown in FIG. 1 of the drawings, the reference numeral 10 refers, in general, to a cubicle that is located in an office, or the like, and includes an upright wall 12 that is connected at one end to an end of another unright wall 14 which extends at a right angle to the wall 12. A horizontally extending support member, or desktop, 16 is mounted to the walls in any known manner.

A conventional computer system is provided in the cubical 10 and includes a monitor 20 and a keyboard 22 supported on the desktop 16, as well as a CPU, or computer chassis, 24 that is supported in an elevated position relative to the desktop by a bracket 30. The chassis has a front face, or wall 24*a*, a rear wall (not shown), a bottom wall 24*b*, an upper wall (not shown), and two side wall 24*c*, one of which is shown in the drawing. The chassis 24 contains several components of a computer, as will be described.

A bracket 30 hangs from the upper edge portion of the wall 12 and will be described in detail. The chassis 24 is placed in the bracket 30 so that one of the side walls 24*c* of the chassis rests on the bottom of the bracket 30 and so that its front wall 24*a* extends vertically and generally faces the monitor. An on-off switch, a light, and one or more drive bays are provided on the front wall 24*a* in a conventional manner. Although not shown in the drawings, it is understood that the above-mentioned rear wall of the chassis 24 is provided with terminals, connectors ports, and the like, to permit the computer components contained in the chassis 24 to be connected to ancillary equipment including the monitor 20 and the keyboard 22, also in a conventional manner.

Figure 2:
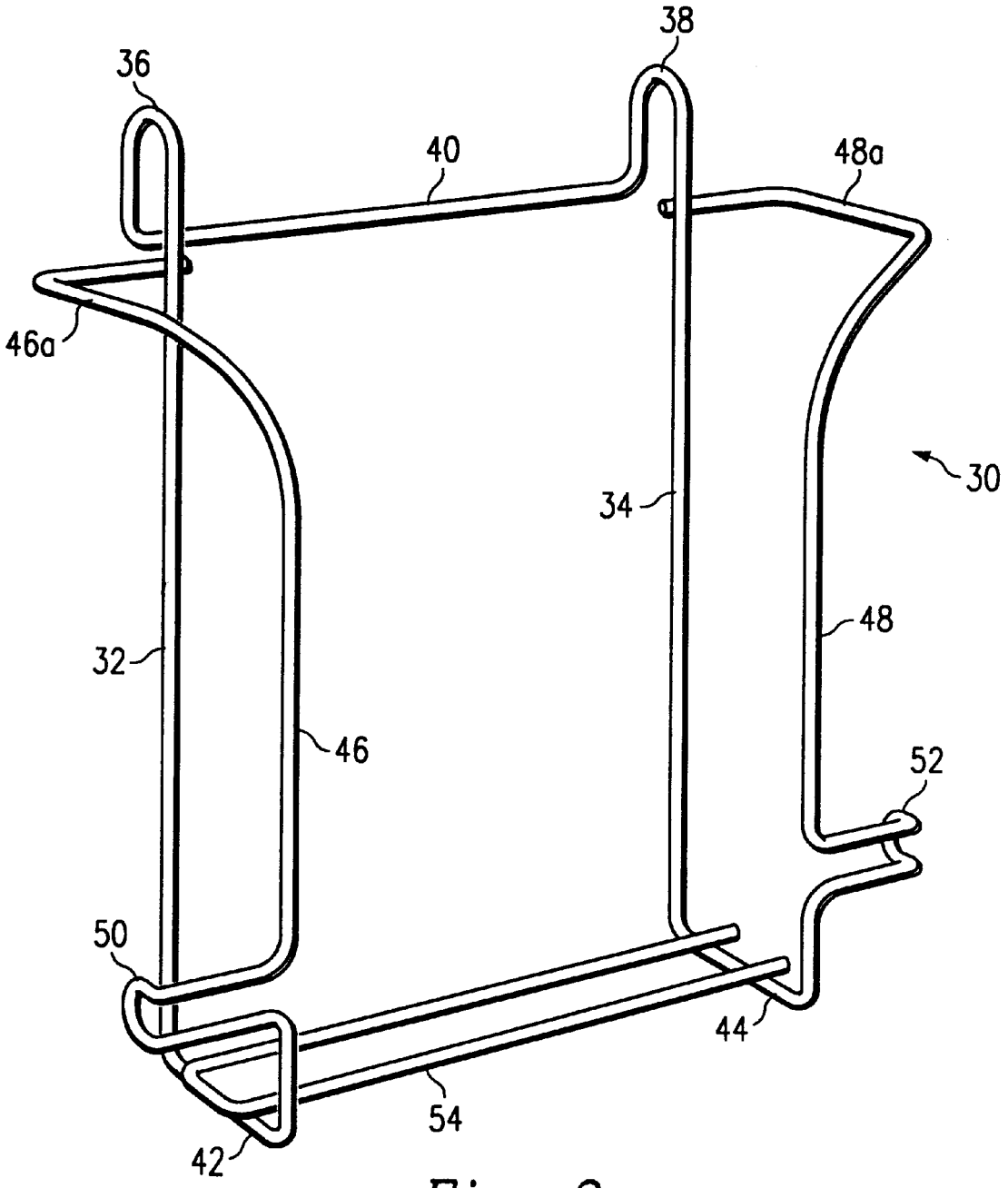
FIG. 2 is an enlarged isometric view of the bracket of FIG. 1.

The bracket 30 is shown in detail in FIG. 2 and includes a framework of rods, preferably, powder-coated steel rods, that are bent and welded in a manner to form two elongated, vertically extending members 32 and 34 extending in a spaced parallel relationship. The upper ends of the members 32 and 34, are bent back and down as viewed in FIG. 2, to form two hooks 36 and 38, respectively, which are connected by a horizonal member 40. Two horizonal members 42 and 44 extend from the lower ends of the members 32 and 34, respectively and are preferably formed by bending the latter members outwardly.

The members 42 and 44 are bent upwardly to form two vertically-extending members 46 and 48, respectively. The members 46 and 48 are bent in several respects to form two arms 50 and 52 which extend out and then back. Also, the upper end portions 46*a* and 48*a* of the members 46 and 48, respectively, are bent out, and then back and in so that they can be connected, at their respective ends, to the members 32 and 34 respectively. These upper end portions 46*a* and 48*a* thus form an enlarged opening for reasons to be described. A U-shaped member 54 is connected at its respective end portions to the horizontal members 42 and 44.

With the exception of the above-described connections of the end portions 46*a* and 48*a* to the members 32 and 34, respectively, and the connections of ends of the member 54 to the members 42 and 44, respectively, the remaining members described above are preferably formed integrally and bent into the configurations as described above.

As shown in FIG. 1, the bracket is positioned relative to the wall 12 so that the hooks 36 and 38 extend over the top edge of the wall to support the bracket on the wall. The computer chassis 24 is then oriented so that its front face 24*a* extends vertically and is positioned above the enlarged upper opening defined by the bent upper end portions 46*a* and 48*a* of the members 46 and 48, respectively. The chassis 24 is then lowered into the bracket 30 until the lower side wall 24*c* of the chassis rests on the horizontal member 54. In the latter position, the arm 50 curls around a corresponding portion of the bottom wall 24*b* of the chassis 24 and around a corresponding portion of the front wall 24*a* of the chassis. Similarly, the arm 52 also curls around a corresponding portion of the bottom wall 24*b* of the chassis 24 and around a corresponding portion of the rear wall of the chassis. The arms 50 and 52 thus prevent any side-to-side movement of the chassis 24.

Figure 3:
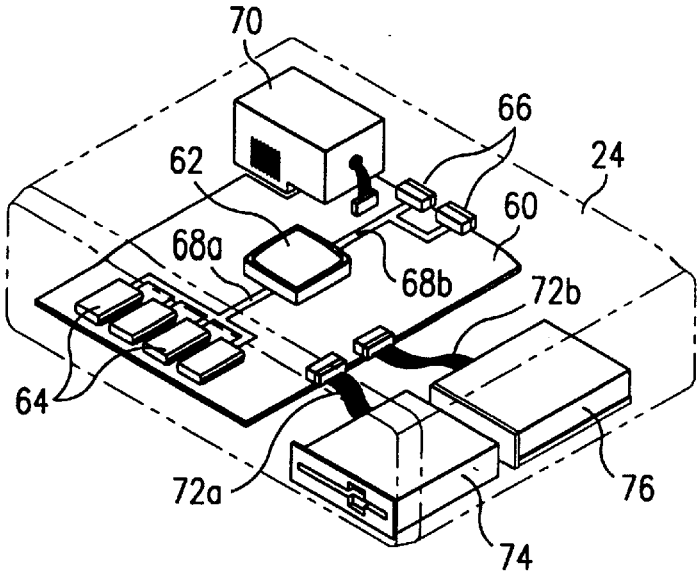
FIG. 3 is a diagrammatic view of the components of the computer, or CPU, that are incorporated in the chassis of FIG. 1.

FIG. 3 depicts the basic computer components that are disposed in the chassis 24 which include a motherboard 60 mounted to the interior of the chassis in any know manner. A processor 62, a plurality of memory devices or modules 64, and two input/output (I/O) devices 66 are mounted on the motherboard 60. Two buses 68*a* and 68*b* are also provided on the motherboard 60 that connect the processor 62 to the memory modules 64 and to the input/output devices 66, respectively. A power supply 70 is connected to the motherboard 60 and a pair of cable assemblies 72*a* and 72*b* connect the motherboard to a hard drive unit 74 and a disk drive unit 76, respectively. It is understood that a video controller is included for connection to the monitor 20 and other components, electrical traces, electrical circuits and related devices are also provided in the chassis 24. Since these are all conventional, they are not shown and will not be described in any further detail.

Several advantages are gained by the embodiment described above For example, the dimensions of the bracket 30 can be selected so that the chassis 24 fits in it in a relatively tight fit to prevent it from rocking back and forth in any direction. Also, the bracket 30 can be quickly removed and installed in a different location by one person. Further, the curved hooks 36 and 38 will fit over any conventional modular wall having an exposed upper edge portion, even those with varying thicknesses, since the top of the wall will naturally find the balanced center within the hooks and properly seat the bracket 30.

Also, even though the chassis 30 is well supported in the above manner, a relatively large portion of the outer surface of the chassis is directly exposed to air so that its thermal integrity will not be affected. Further, the bracket 30 does not restrict the access to any plugs, cables, switches, buttons, indicators, ports, drive openings, etc. on the front and the rear of the chassis 24. Moreover, the bracket 30 is very versatile in the sense that it can be installed on either side of a cubicle wall, and computer orientation with the bracket becomes intuitively obvious to the installer/user. Still further, the hooks 36 and 38 will not permanently deform or mark the cubicle wall surfaces.

It is understood that several variations may be made in the foregoing without departing from the scope of the invention. For example, the various members forming the bracket 30 can be formed of heavy wire, or the like, rather than rods. Also, these members can be bent instead of connected and/or can be formed into individual members and connected, rather then being bent. Further, the hooks 36 and 38 can support the bracket 30 over any structure, other than a wall, having an accessible upper edge. Also, the specific number of rod members, hooks, and arms froming the bracket 30 be varied.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A bracket for supporting a chassis having a first pair of opposed walls, a second pair of opposed walls extending from, and perpendicular to, the first pair of opposed walls, and a third pair of opposed walls extending from, and perpendicular to, the first and second pair of opposed walls; the bracket comprising a first pair of spaced, parallel, support members engaging one wall of the first pair of opposed walls, a second pair of spaced parallel support members having opposite ends, the first end extending from the first pair of support members and bent relative to the first pair of support members in a manner to engage said third pair of opposing walls and engage the other wall of the first pair of opposed walls, a third pair of support members extending between the first pair of support members and the second ends of the second pairs of support members, respectively, and bent relative to the first and second pairs of support members for respectively supporting one of the second pair of opposed walls, a fourth pair of support members respectively extending from and intermediate the ends of the second pair of support members and bent relative to the second pair of support members in a manner to respectively engage the third pair of opposed walls.

2. The bracket of claim 1 wherein the first pair of support members engage the one wall of the first pair of opposed walls for substantially its entire length.

3. The bracket of claim 1 wherein the second pair of support members engage the one wall of the first pair of opposed walls for substantially its entire length.

4. The bracket of claim 1 wherein each wall is rectangular in shape and has a relative long dimension and a relatively short dimension, the first and second pair of support members engaging their respective walls along their respective long dimensions.

5. The bracket of claim 4 wherein the third and fourth pair of support members engage their respective walls along their relatively short dimensions.

6. The bracket of claim 1 further comprising a pair of cross pieces extending between the third pair of support members for further supporting the one wall of the second pair of walls.

7. The bracket of claim 1 wherein each support member of the fourth pair of support members has a first portion engaging the other wall of the first pair of walls, and a second portion extending from, and at right angles to, the first portion and engaging the respective wall of the third pair of walls.

8. The bracket of claim 1 wherein the support members of the third pair of support members are formed integrally with, the support members of the first and second pairs of support members.

9. The bracket of claim 8 wherein the fourth and fifth pairs of support members are formed integrally with the second pair of support members, respectively.

10. The bracket of claim 1 wherein each pair of the fourth and fifth pairs of support members engage the respective walls of the third pair of walls at spaced intervals.

11. The bracket of claim 1 wherein the first pair of support members are bent to respectively form a pair of hooks for engaging an upper edge portion of a structure to which the chassis is to be mounted.

12. The bracket of claim 11 wherein the one wall of the first pair of opposed walls rests against the structure.

13. A bracket for supporting a chassis having a first pair of opposed walls, a second pair of opposed walls extending from, and perpendicular to, the first pair of opposed walls, and a third pair of opposed walls extending from, and perpendicular to, the first and second pair of opposed walls; the bracket comprising a first pair of spaced, parallel, support members engaging one wall of the first pair of opposed walls, a second pair of spaced parallel support members having opposite ends, the first end extending from the first pair of support members and bent relative to the first pair of support members in a manner to engage the other wall of the first pair of opposed walls for substantially the length of the chasis, a third pair of support members extending between the first pair of support members and the second ends of the second pairs of support members, respectively, and bent relative to the first and second pairs of support members, a pair of cross pieces extending between the third pair of support members for respectively engaging one wall of the second pair of walls, and a fourth pair of support members extending from and intermediate the ends of the second pair of support members and bent relative to the second pair of support members in a manner to respectively engage the third pair of opposed walls.

14. The bracket of claim 13 wherein the first pair of support members engage the one wall of the first pair of opposed walls for substantially its entire length.

15. The bracket of claim 13 wherein the second pair of support members engage the one wall of the first pair of opposed walls for substantially its entire length.

16. The bracket of claim 13 wherein each wall is rectangular in shape and has a relative long dimension and a relatively short dimension, the first and second pair of support members engaging their respective walls along their respective long dimensions.

17. The bracket of claim 16 wherein the third and fourth pair of support members engage their respective walls along their relatively short dimensions.

18. The bracket of claim 13 wherein each support member of the fourth pair of support members has a first portion engaging the other wall of the first pair of walls, and a second portion extending from, and at right angles to, the first portion and engaging the respective wall of the third pair of walls.

19. The bracket of claim 13 wherein the support members of the third pair of support members are formed integrally with, the support members of the first and second pairs of support members.

20. The bracket of claim 19 wherein the support members of the fourth pair of support members are formed integrally with the second pair of support members, respectively.

21. The bracket of claim 13 wherein the first pair of support members are bent to respectively form a pair of hooks for engaging an upper edge portion of a structure to which the chassis is to be mounted.

22. The bracket of claim 21 wherein the one wall of the first pair of opposed walls rests against the structure.

* * * * *